US006068304A

United States Patent [19]

Lindqvist

[11] Patent Number: 6,068,304

[45] **Date of Patent: *May 30, 2000**

[54] ESPAGNOLETTE EDGE BAR ASSEMBLY

[75] Inventor: Per Olof Lindqvist, Onsala, Sweden

[73] Assignee: Fix AB, Gothenburg, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 09/019,258

[22] Filed: Feb. 5, 1998

[51] Int. Cl.[7] ..... E05C 19/00

[52] U.S. Cl. ..... 292/1; 292/5; 292/32; 292/DIG. 53

[58] Field of Search ..... 292/1, 32, 33, 292/34, 35, 36, 39, 138, 139, 5, 8, DIG. 53, DIG. 54

[56] References Cited

U.S. PATENT DOCUMENTS

| | | | |
|---|---|---|---|
| 51,059 | 11/1865 | Jordon . | |
| 1,895,892 | 1/1933 | Moore . | |
| 3,695,068 | 10/1972 | Eads et al. | 70/107 |
| 3,788,679 | 1/1974 | Banham | 292/40 |
| 4,002,360 | 1/1977 | Frank et al. | 292/336.3 |
| 4,518,178 | 5/1985 | Bengtsson | 292/8 |
| 4,548,432 | 10/1985 | Bengtsson | 292/8 |
| 4,616,864 | 10/1986 | Douglas | 292/336.3 |
| 4,643,005 | 2/1987 | Logas | 70/95 |
| 4,921,285 | 5/1990 | Loos | 292/39 |
| 4,961,602 | 10/1990 | Pettersson | 292/98 |
| 4,998,757 | 3/1991 | Ramsauer | 292/39 |
| 5,102,174 | 4/1992 | Prevot | 292/336.3 |
| 5,118,143 | 6/1992 | Gerard | 292/39 |
| 5,244,238 | 9/1993 | Lindqvist | 292/7 |
| 5,253,903 | 10/1993 | Daley | 292/39 |
| 5,452,925 | 9/1995 | Huang | 292/57 |

FOREIGN PATENT DOCUMENTS

| | | | |
|---|---|---|---|
| 598927A1 | 6/1994 | European Pat. Off. | 292/34 |
| 2 620 482 | 9/1987 | France . | |
| 1184157 | 3/1970 | United Kingdom | 292/5 |

*Primary Examiner*—B. Dayoan
*Assistant Examiner*—Clifford B Vaterlaus
*Attorney, Agent, or Firm*—Samuels, Gauthier & Stevens, LLP

[57] ABSTRACT

An espagnolette edge bar assembly for use in a latch assembly. The espagnolette edge bar assembly includes an espagnolette edge bar lock housing mounting means (14) attached to the espagnolette edge bar, and an espagnolette rod connector associated with the lock housing mounting means. The espagnolette rod connector is arranged for displacement along the espagnolette edge bar.

4 Claims, 3 Drawing Sheets

ESPAGNOLETTE EDGE BAR ASSEMBLY

TECHNICAL FIELD:

The present invention relates to an espagnolette edge bar assembly for use in an espagnolette latch assembly on closure members such as doors, windows and shutters.

BACKGROUND OF THE INVENTION:

A latch assembly for keeping doors, windows, shutters and the like in a closed position is disclosed in U.S. Pat. No. 4,548,432. The known assembly comprises a lock casing attached for example via rivets to an espagnolette edge bar. The bar and the lock casing are arranged to be accommodated in a recess in a door. The lock casing houses operating elements responsive to movement of a handle on the lock casing for manoeuvring at least one bolt from a retracted position to an extended position and back. The operating elements include an espagnolette rod emerging from the lock casing and running parallel to the edge bar from the lock casing to the bolt or bolts. Operation of the handle on the lock casing causes displacement of the espagnolette rod which, in turn, effects displacement of the bolt or bolts.

Depending on the chosen application, different demands are placed on latch assemblies. For example, for a window application, it is not always necessary that the latch assembly be lockable with a key-actuated lock. In other applications, for example on some doors in business premises, it is necessary that the door be openable from one side without the use of a key, though openable from the other side solely with the use of a key. Thus, different operating modes are required of latch assemblies depending on the circumstances of the chosen application.

Since the espagnolette rod of the above-described known latch assembly is an integral part of the operating elements of the lock housing, a unique latch assembly comprising lock housing, espagnolette edge bar and bolt, together with associated operating elements, must be produced for each different chosen application.

SUMMARY OF THE INVENTION:

It is therefore an object of the present invention to provide an espagnolette edge bar assembly which is suitable for use with different lock housings, each lock housing having a unique operating mode.

This object is achieved by an espagnolette edge bar assembly comprising an espagnolette edge bar, lock housing mounting means attached to the espagnolette edge bar, and an espagnolette rod connector associated with the lock housing mounting means, the espagnolette rod connector being arranged for displacement along the espagnolette edge bar.

In a preferred embodiment of the invention, the lock housing mounting means comprises a pair of mounting brackets and the espagnolette rod connector is arranged to pass between the pair of mounting brackets. Advantageously, each mounting bracket presents a longitudinal opening for accommodating a portion of the espagnolette rod connector. The longitudinal opening is suitably formed by a gap between the espagnolette edge bar and a portion of the mounting bracket.

In accordance with a further aspect of the invention, the espagnolette rod connector is an elongate strip of material having opposed longitudinal edge portions. A length of the longitudinal edge portions may be bent to form the portion of the espagnolette rod connector which is accommodated in the longitudinal opening of each mounting bracket. Advantageously, the espagnolette rod connector has a central portion disposed between the longitudinal edge portions, with the central portion being provided with at least one opening through which a bolt of a lock housing may project. In addition, the central portion of the espagnolette rod connector can be provided with a pair of transversely extending walls for cooperating with an operating element of a lock housing.

In accordance with the present invention, by grouping together in an espagnolette edge bar assembly those components which are necessary for transmitting desired functions of a lock housing to associated bolts, one and the same edge bar assembly can be used for a large variety of differently functioning lock housings.

BRIEF DESCRIPTION OF THE DRAWINGS:

The present invention will be described in the following in greater detail by way of example only and with reference to the attached drawings, in which.

Figure 1:
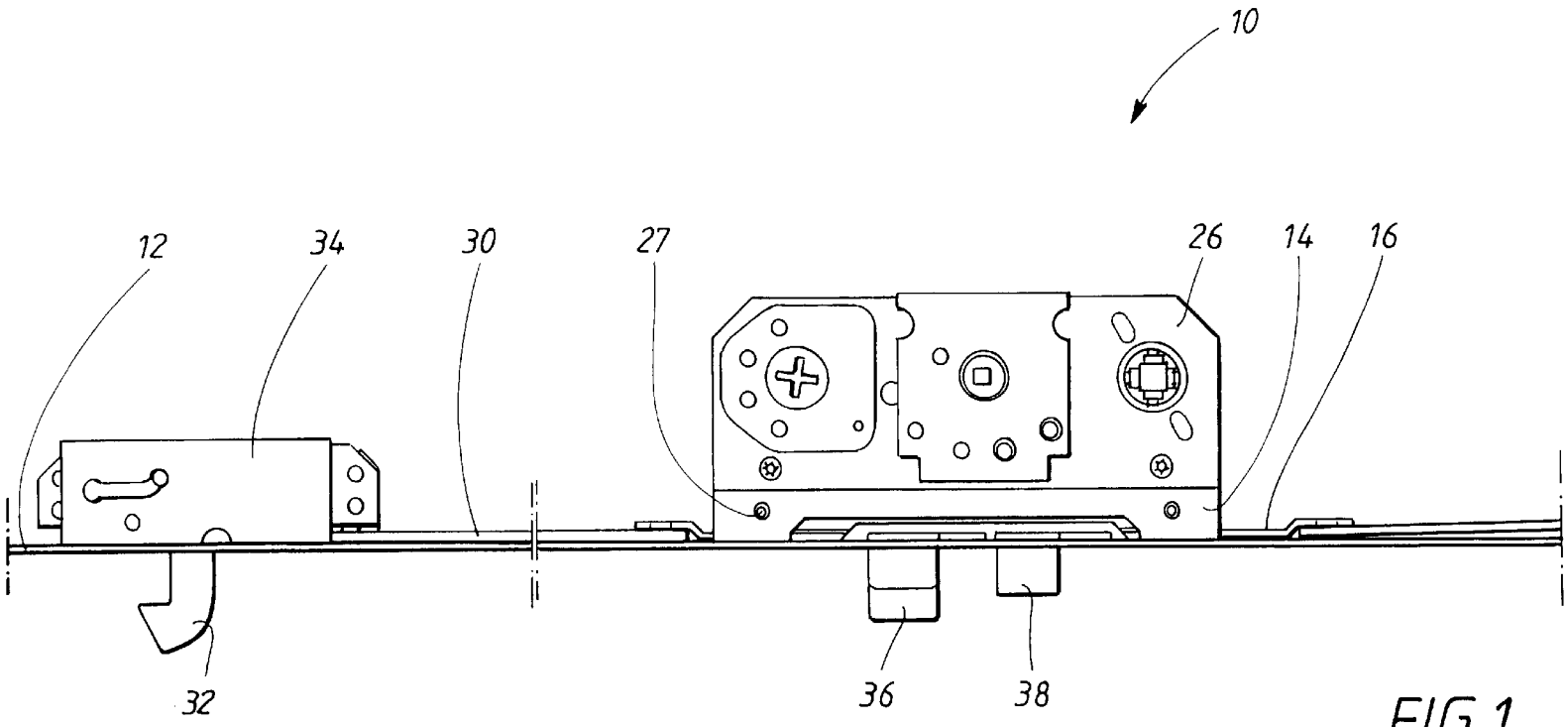
FIG. 1 is schematic elevational view of a latch assembly incorporating an espagnolette edge bar assembly according to the present invention.

DETAILED DESCRIPTION OF PREFERRED EMBODIMENTS:

In the drawings, reference numeral 10 generally denotes an espagnolette edge bar assembly according to the present invention. In FIG. 1, the espagnolette edge bar assembly 10 is shown in use together with a latch assembly. The latch assembly is intended to be attached to a not-shown closure member.

Figure 2:
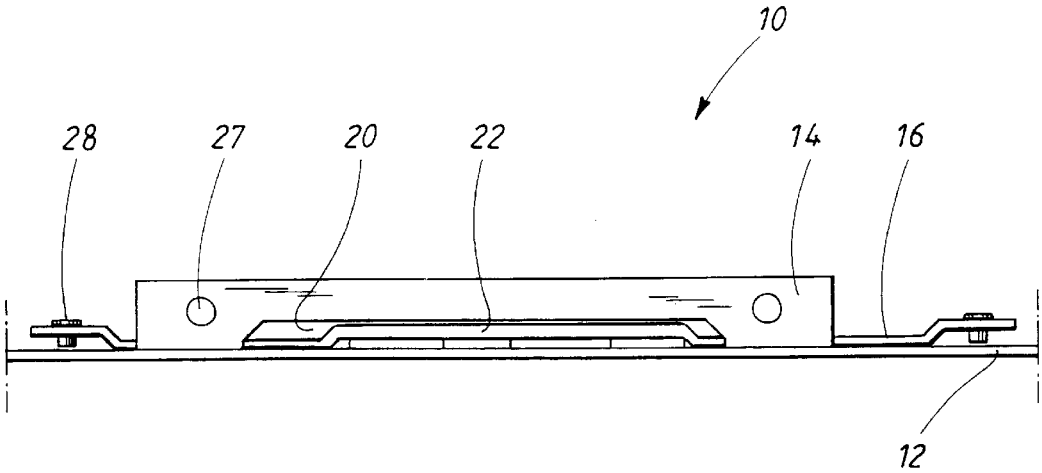
FIG. 2 is a schematic elevational view of a portion of the espagnolette edge bar assembly according to the present invention.
Figure 3:
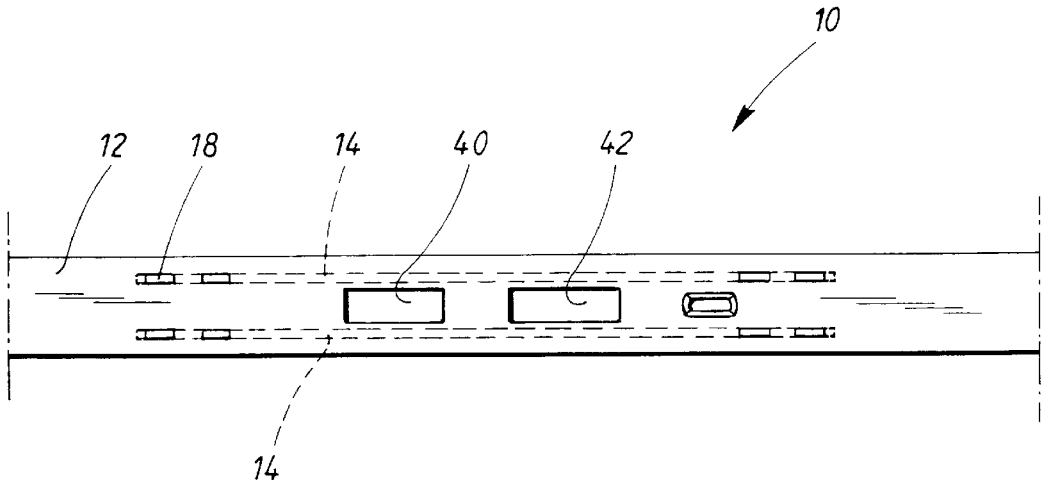
FIG. 3 is a plan view of the portion shown in FIG. 2.

With particular reference to FIGS. 2 and 3, the espagnolette edge bar assembly 10 of the present invention comprises an espagnolette edge bar 12, lock housing mounting means 14 affixed to the espagnolette edge bar 12, and an espagnolette rod connector 16 associated with the lock housing mounting means, the espagnolette rod connector 16 being arranged for displacement along the espagnolette edge bar 12. Preferably, the lock housing mounting means comprises a pair of mounting brackets 14 which are provided with a plurality of tabs 18 fixedly secured in correspondingly shaped openings in the espagnolette edge bar 12. Each mounting bracket 14 presents a longitudinal opening 20 of predetermined length which may be formed by a gap having a predetermined depth between the espagnolette edge bar and a portion of each bracket. The openings 20 are intended to accommodate a portion 22 of the espagnolette rod connector 16 when the espagnolette rod connector 16 is placed between the pair of mounting brackets 14.

Figure 4:
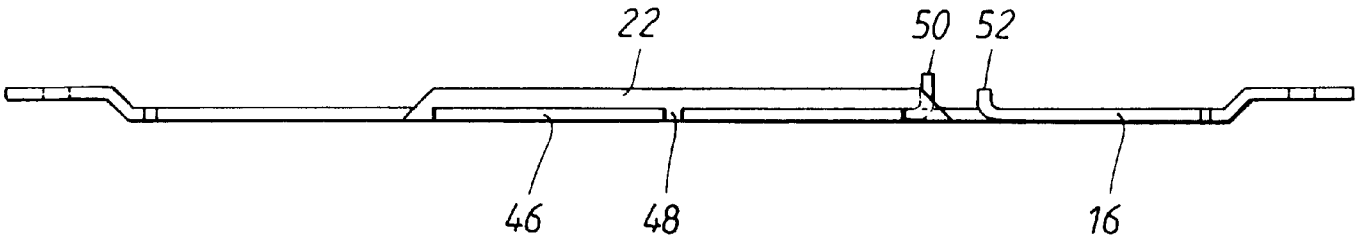
FIG. 4 is a schematic elevational view of an espagnolette rod connector forming a part of the espagnolette edge bar assembly of the present invention.
Figure 5:
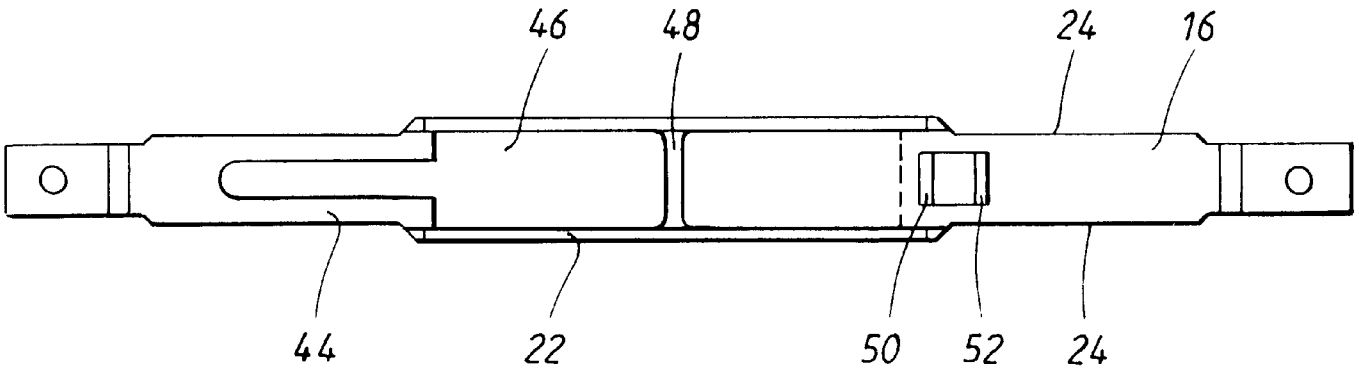
FIG. 5 is a plan view of the espagnolette rod connector of FIG. 4.

With particular reference to FIGS. 4 and 5, the espagnolette rod connector 16 is preferably an elongate strip of material having opposed longitudinal edge portions 24. A length of each longitudinal edge portion is bent to form the portion 22 of the espagnolette rod connector 16 which is accommodated in the longitudinal opening 20 of each mounting bracket 14. The length of the bent portions 22 is less than that of the predetermined length of the openings 20 to thereby allow the espagnolette rod connector 16 to be displaceable along the espagnolette edge bar 12. Furthermore, the bent portions 22 provide the espagnolette rod connector with a depth of section which is somewhat less than the predetermined depth of the gaps forming the openings 20 so that the espagnolette rod connector may freely slide along the espagnolette edge bar.

Referring back to FIG. 1, it will be seen that the mounting brackets 14 support a lock housing 26. The lock housing may be attached to the mounting brackets by screws passing through locating holes 27 in each bracket. The lock housing is provided with not-shown operating elements to effect displacement of the espagnolette rod connector 16 along the espagnolette edge bar 12. At least one end of the espagnolette rod connector is provided with connection means 28, for example a rivet (FIG. 2), to allow the espagnolette rod connector to be connected to an espagnolette rod 30. Displacement of the espagnolette rod 30 effects displacement of an espagnolette bolt 32 between a retracted position within a bolt housing 34 mounted on the espagnolette edge bar 12 to an extended position shown in the drawing.

As is customary, the lock housing 26 may be provided with a bevelled bolt 36 and a dead bolt 38. The espagnolette bolt 32, bevelled bolt 36 and dead bolt 38 are intended to engage with recesses in a frame surrounding the closure member to which the latch assembly is attached. In order to allow the bolts to extend from their respective housings, the espagnolette edge bar 12 is provided with suitable openings. In FIG. 3, openings for the bevelled bolt 36 and the dead bolt 38 are denoted by reference numerals 40 and 42 respectively.

Since the espagnolette rod connector 16 is arranged to be located between the espagnolette edge bar 12 and the lock housing 26, the espagnolette rod connector must also allow the passage of bolts therethrough. Accordingly, and as is most clearly apparent from FIG. 5, the espagnolette rod connector 16 has a central portion 44 disposed between the longitudinal edge portions 24, the central portion being provided with at least one opening 46 through which the bolts of the lock housing may project. In order to impart adequate strength to the espagnolette rod connector, it my be advantageous to divide the opening 46 with a tie bar 48. Care should be taken, however, to ensure that the tie bar 48 will not interfere with either of the bolts 36,38 during the sliding displacement of the espagnolette rod connector 16.

The espagnolette rod connector 16 illustrated in FIGS. 4 and 5 is also provided with a pair of transversely extending walls 50,52 formed by stamping out a region of the central portion 44 of the espagnolette rod connector. The pair of walls is intended to cooperate with an operating element within a lock housing mounted to the mounting brackets 14 of the espagnolette edge bar assembly 10, which operating element causes the sliding displacement of the espagnolette rod connector 16.

The invention is not restricted to the embodiments described above and shown in the drawings, but may be varied in many ways within the scope of the appended claims. For example, the espagnolette rod connector may effect operation of a plurality of espagnolette bolts.

What is claimed is:

1. An espagnolette edge bar assembly for use in a latch assembly, said espagnolette edge bar assembly comprising:

an espagnolette edge bar;

lock housing mounting means attached to said espagnolette edge ba,r said mounting means including a pair of mounting brackets, and an espagnolette rod connector associated with said lock housing mounting means, said espagnolette rod connector being arranged for displacement along said espagnolette edge bar, said espagnolette rod connector passing between and underneath said pair of mounting brackets, each mounting bracket defining a longitudinal opening for accommodating a portion of said espagnolette rod connector, each longitudinal opening being formed by a gap between said espagnolette edge bar and a portion of said mounting bracket, wherein said espagnolette rod connector has a central portion being provided with at least one opening through which a bolt of a lock housing is adapted to project.

2. The espagnolette edge bar assembly as claimed in claim 1, wherein said espagnolette rod connector is an elongate strip of material having opposed longitudinal edge portions, a length of said longitudinal edge portions being bent to form said portion of said espagnolette rod connector which is accommodated in said longitudinal opening of each mounting bracket.

3. The espagnolette edge bar assembly as claimed in claim 2, wherein said espagnolette rod connector has a central portion disposed between said longitudinal edge portions.

4. The espagnolette edge bar assembly as claimed in claim 3 wherein said central portion of said espagnolette rod connector is provided with a pair of transversely extending walls for cooperating with an operating element of a lock housing.

* * * * *